US006439411B1

(12) United States Patent
Schwarz

(10) Patent No.: US 6,439,411 B1
(45) Date of Patent: Aug. 27, 2002

(54) CONTAINER CLOSURE SYSTEM WITH WARRANTY ELEMENT

(75) Inventor: Werner Schwarz, Reinach (CH)

(73) Assignee: H. Obrist & Co., AG, Reinach (CH)

( * ) Notice: Subject to any disclaimer, the term of this patent is extended or adjusted under 35 U.S.C. 154(b) by 0 days.

(21) Appl. No.: 09/601,364

(22) PCT Filed: Feb. 1, 1999

(86) PCT No.: PCT/CH99/00041

§ 371 (c)(1),
(2), (4) Date: Aug. 1, 2000

(87) PCT Pub. No.: WO99/41157

PCT Pub. Date: Aug. 19, 1999

(30) Foreign Application Priority Data

Feb. 16, 1998 (EP) ..... 98810121

(51) Int. Cl.[7] ..... B65D 41/34

(52) U.S. Cl. ..... 215/252; 215/258; 215/330; 215/44; 215/276; 222/541.5

(58) Field of Search ..... 222/541.5, 153.14; 215/252, 258, 253, 250, 331, 354, 44, 45, 276, 274, 230; 220/319, 266

(56) References Cited

U.S. PATENT DOCUMENTS

| | | | | | |
|---|---|---|---|---|---|
| 3,310,191 | A | * | 3/1967 | Kern et al. | 215/252 |
| 3,874,540 | A | * | 4/1975 | Hidding | 215/252 |
| 3,977,557 | A | * | 8/1976 | Hazard | 215/274 |
| 4,457,437 | A | * | 7/1984 | Heath, Jr. | 215/252 X |
| 4,534,479 | A | * | 8/1985 | Conti | 215/252 |
| 4,570,810 | A | * | 2/1986 | Hawkins | 215/253 |
| 4,572,389 | A | * | 2/1986 | Gach | 215/253 |
| 4,775,064 | A | * | 10/1988 | Baxter | 215/252 X |
| 4,782,964 | A | * | 11/1988 | Poore et al. | 215/253 X |
| 4,805,791 | A | * | 2/1989 | Begley | 215/252 |
| 5,131,549 | A | * | 7/1992 | Battegazzore | 215/252 |
| 5,328,046 | A | * | 7/1994 | Kutz et al. | 215/252 X |

FOREIGN PATENT DOCUMENTS

| | | | | |
|---|---|---|---|---|
| FR | 2290364 | * | 6/1976 | 215/252 |
| GB | 10527834 | * | 12/1966 | 215/252 |

* cited by examiner

*Primary Examiner*—Stephen K. Cronin
*Assistant Examiner*—Robin A. Hylton
(74) *Attorney, Agent, or Firm*—Shoemaker and Mattare

(57) ABSTRACT

A container closure system comprises a container having an opening zone (21) with a threaded neck (22). A closure cap (23) can be screwed on the threaded neck (22). A warranty element comprises an annular base body (25) with engagement means which can engage matching engagement means (38) in the opening zone (21) of the container. The warranty element also comprises one or more indicator elements (27) shaped as circle segments and linked each by a predetermined breaking strip to the base body (25). The closure cap (23) has at least one axial projection (34) which can be inserted between the ends of the indicator elements (27) shaped as circle segments or between the ends of two adjacent indicator elements (27) in order to secure the indicator elements (27) against rotation to the closure cap (23). When the closure cap (23) is unscrewed, these axial projections (34) break the predetermined breaking strips, separating the indicator elements (27) shaped as circle segments from the base body (25). This indicates that the container has been opened for the first time.

7 Claims, 9 Drawing Sheets

CONTAINER CLOSURE SYSTEM WITH WARRANTY ELEMENT

BACKGROUND

The invention relates to a container closure arrangement including a container which comprises an opening region with a threaded neck, and a closure cap which may be screwed onto the threaded neck. The cap has a guarantee element having an annular base body with latching means which, in the unscrewing direction, can be brought into engagement with complementary latching means on the opening region of the container, and at least one circular segment-shaped indicator body which may be brought into rotationally fixed engagement with the closure cap. The indicator body is connected by at least one break-off web to the base body.

As a rule, in a container closure arrangement of this type, the guarantee element and the closure cap are stuck together and then together are screwed onto the threaded neck of the container. During the screwing-on, the latching means of the base body may snap over the latching means on the opening region of the container. On unscrewing the closure cap from the threaded neck, the latching means of the base body then come into engagement with the latching means on the opening region so that the base body may not rotate with the closure cap. The closure cap entrains the indicator body so that the latter is released from the base body. This provides an indication that the container has been opened.

In known container closure arrangements of the indicated type, e.g. according to DE 296 10 161.3 U, the indicator body is annular and, for the bringing into engagement with the closure cap, comprises a plurality of radially inwardly protruding projections which may engage between ribs on the outer side of the closure cap. This design has the disadvantage that after the first opening of the container, the annular indicator body with its projections may again be pressed between the ribs on the closure cap, and thus the opening of the container may be concealed.

SUMMARY OF THE INVENTION

It is the object of the invention to avoid this disadvantage with a container closure arrangement of the above specified type.

According to the invention, this object is achieved in that the closure cap for bringing into rotationally secure engagement comprises at least one axially protruding projection accommodated between the ends of the circular-segment-shaped indicator body, or between the ends of two neighboring indicator bodies.

An additional improvement in security may be achieved by providing the closure cap with axially protruding inclined ramps running in the circumferential direction, which on rotating the closure cap placed on the threaded neck, in the unscrewing direction press the base body and the indicator body away from one another.

In place of the inclined ramps on the closure cap, however, there may also be arranged second projections with a constant axial height which on rotating the closure cap in the unscrewing direction shear the indicator body from the base body so that this indicator body falls from the base body remaining in the closure cap.

An important advantage of the container closure arrangement designed according to the invention lies also in the fact that—in particular when only one or two circular—segment—shaped indicator bodies are present—the indicator body or bodies, together with the closure cap, are always compellingly located in a predetermined rotational position with respect to the closure cap, and thus also with respect to the container. This predetermined rotational position may be selected such that the releasing of the indicator body or one of the indicator bodies from the base body on opening the container is effected at an optimally visible location, for example roughly in the middle of the front side of a container, the front side being identified by the containers shape (e.g. oval) or by way of a label, wherein the front side on purchase faces or is faced to a purchaser.

BRIEF DESCRIPTION OF THE DRAWINGS

Embodiment examples of the container closure arrangement according to the invention are hereinafter described in more detail by way of the drawings, wherein.

DESCRIPTION OF THE PREFERRED EMBODIMENTS

Figure 1:
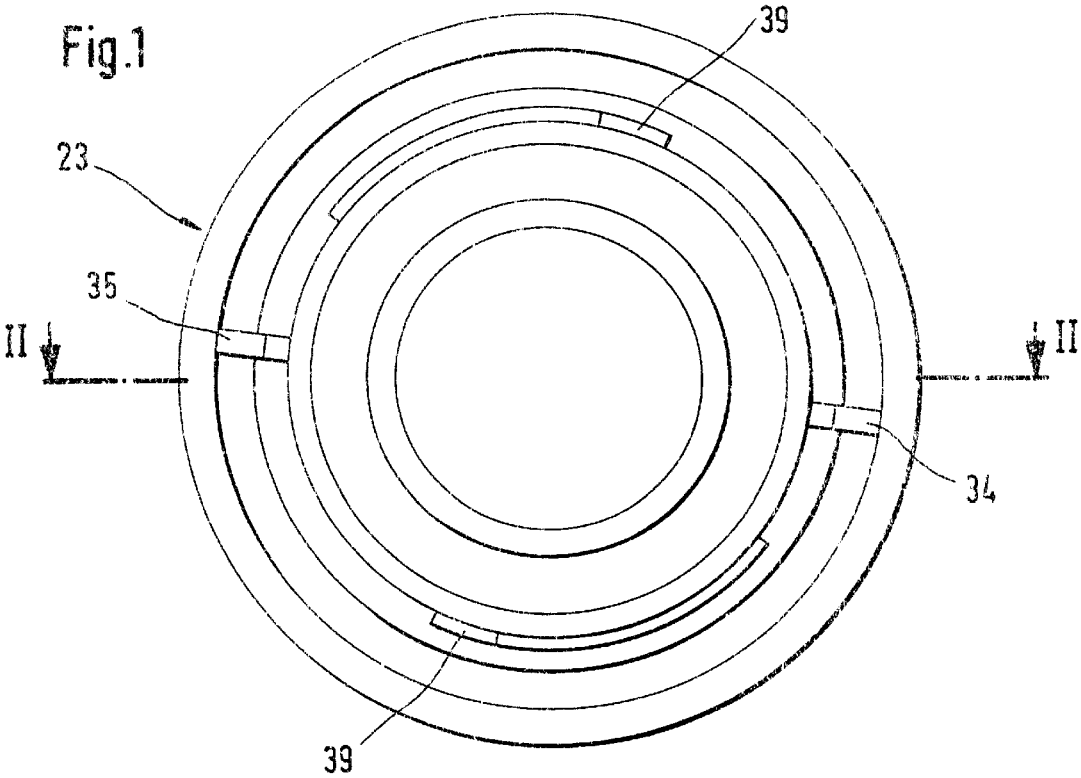
FIG. 1 is a view of a closure cap from below.
Figure 2:
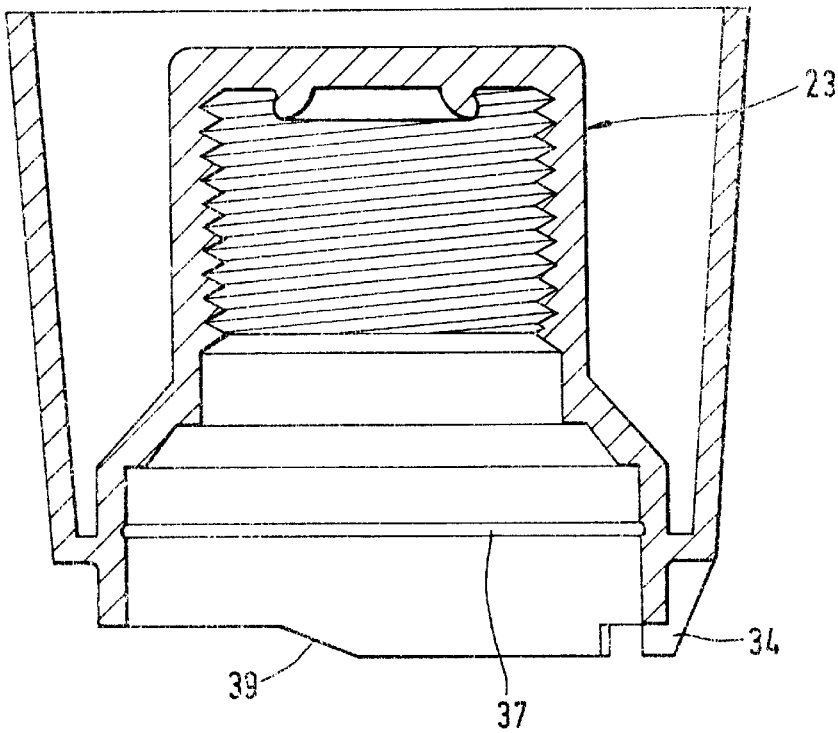
FIG. 2 is a section through the closure cap taken on line 2—2 in FIG. 1.
Figure 8:
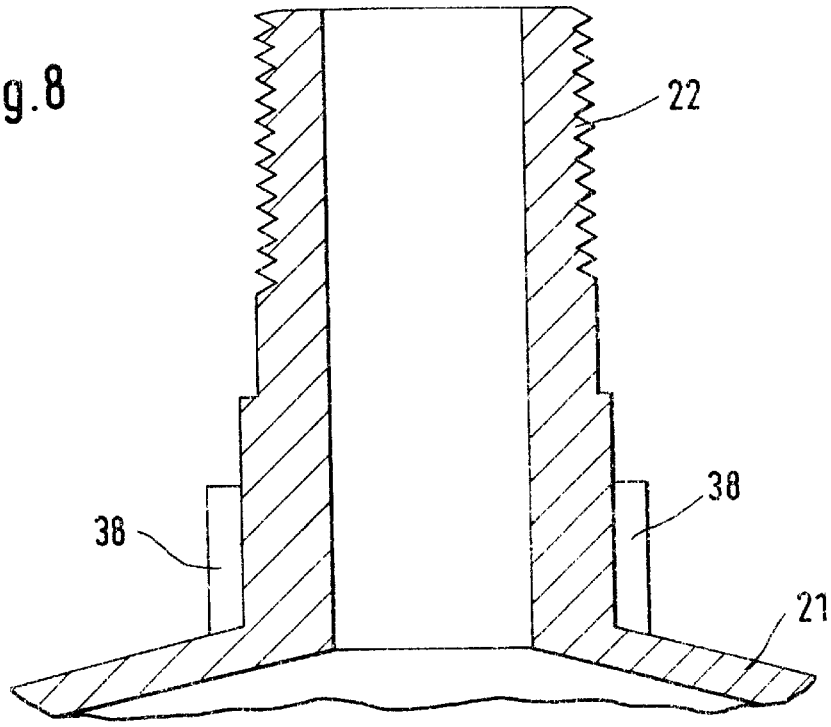
FIG. 8 is a section through the opening region and the threaded neck of a container.
Figure 9:
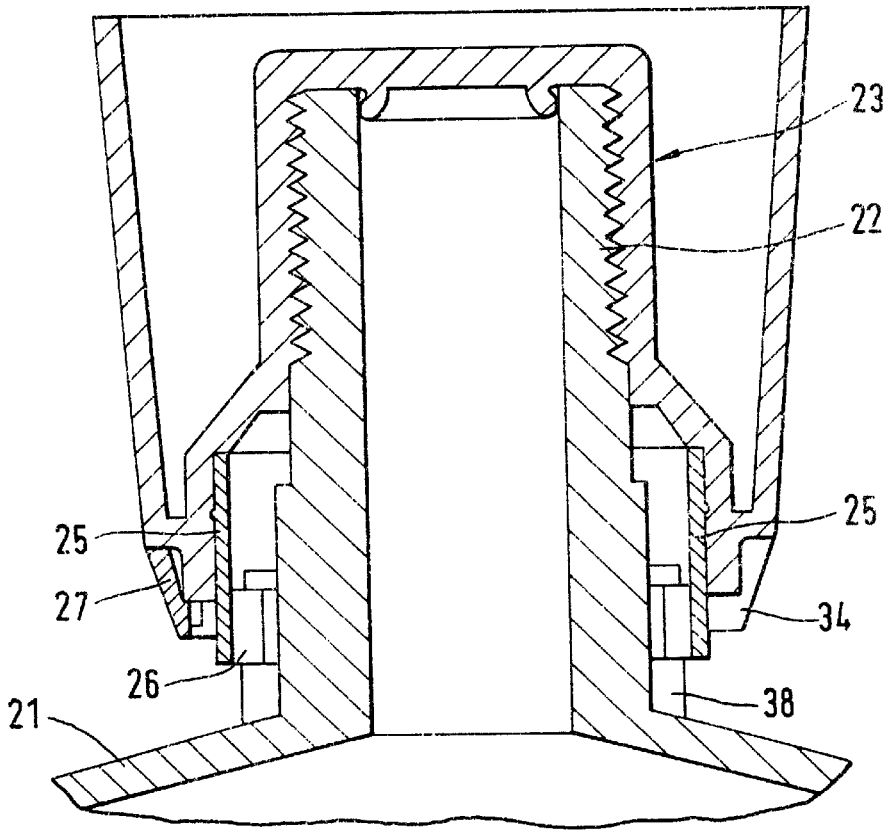
FIG. 9 is a similar section as FIG. 8, but with a closure cap and a closure element installed.
Figure 10:
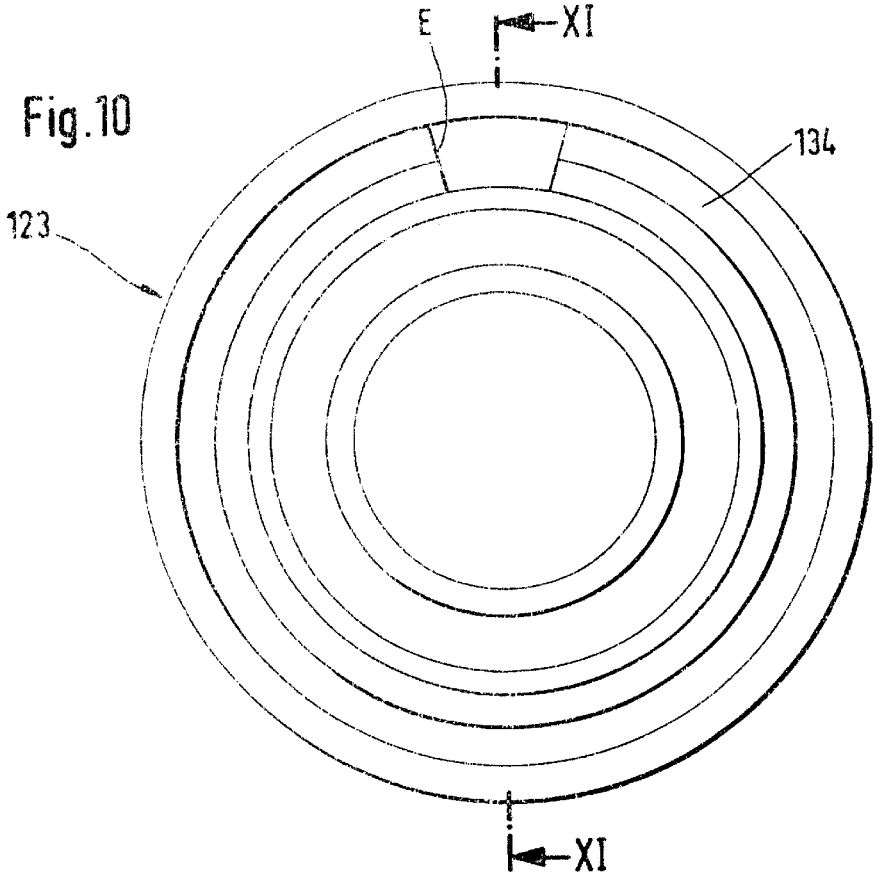
FIG. 10 is a view according to FIG. 1 of another closure cap from below.
Figure 11:
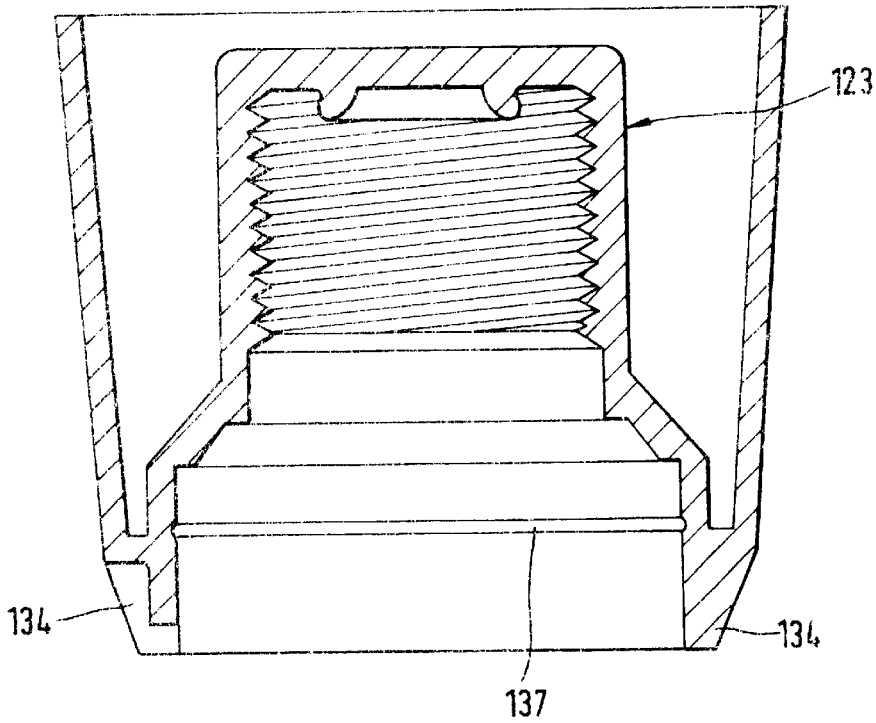
FIG. 11 is a section taken on line 11—11 in FIG. 10.
Figure 12:
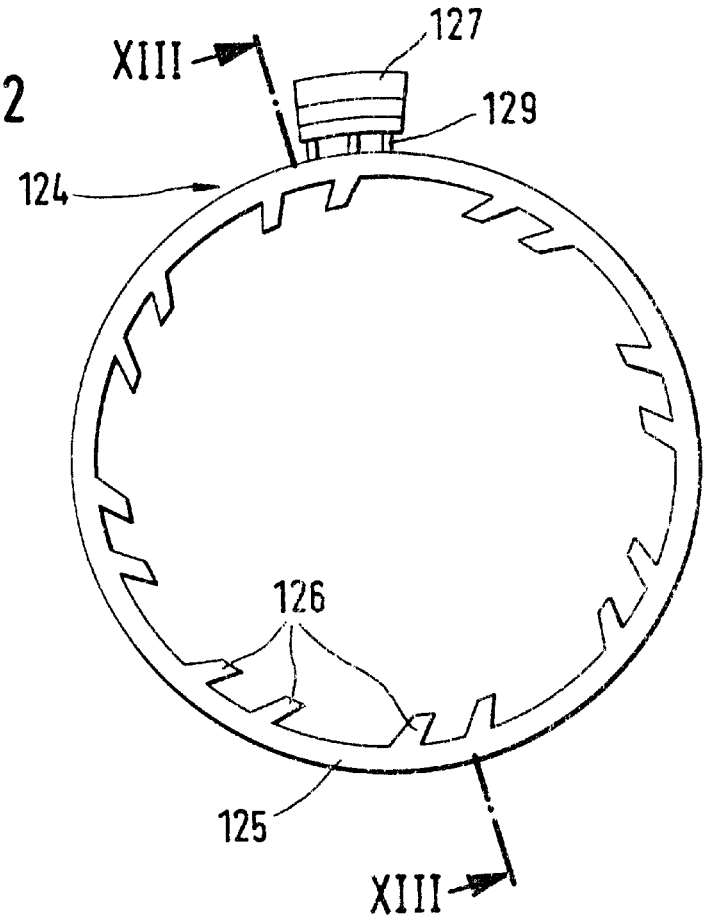
FIG. 12 is a plan view of a guarantee element for use with the closure cap of FIG. 10 and 11.
Figure 13:
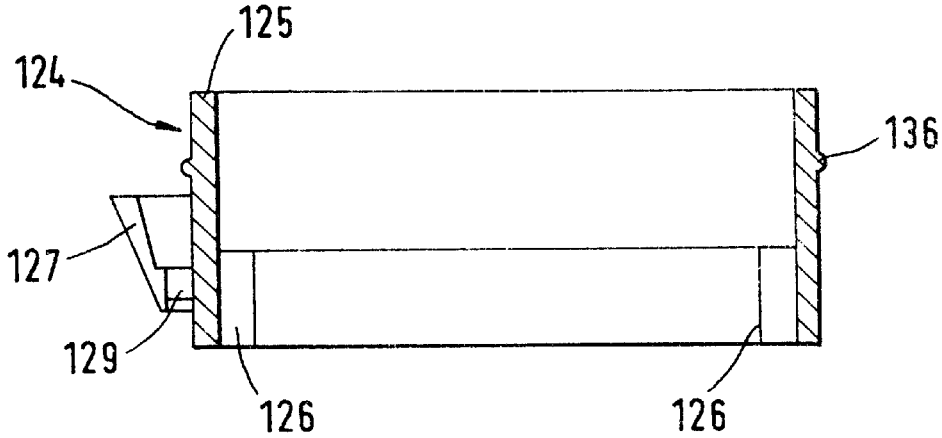
FIG. 13 is a section taken on line 13—13 in FIG. 12.
Figure 14:
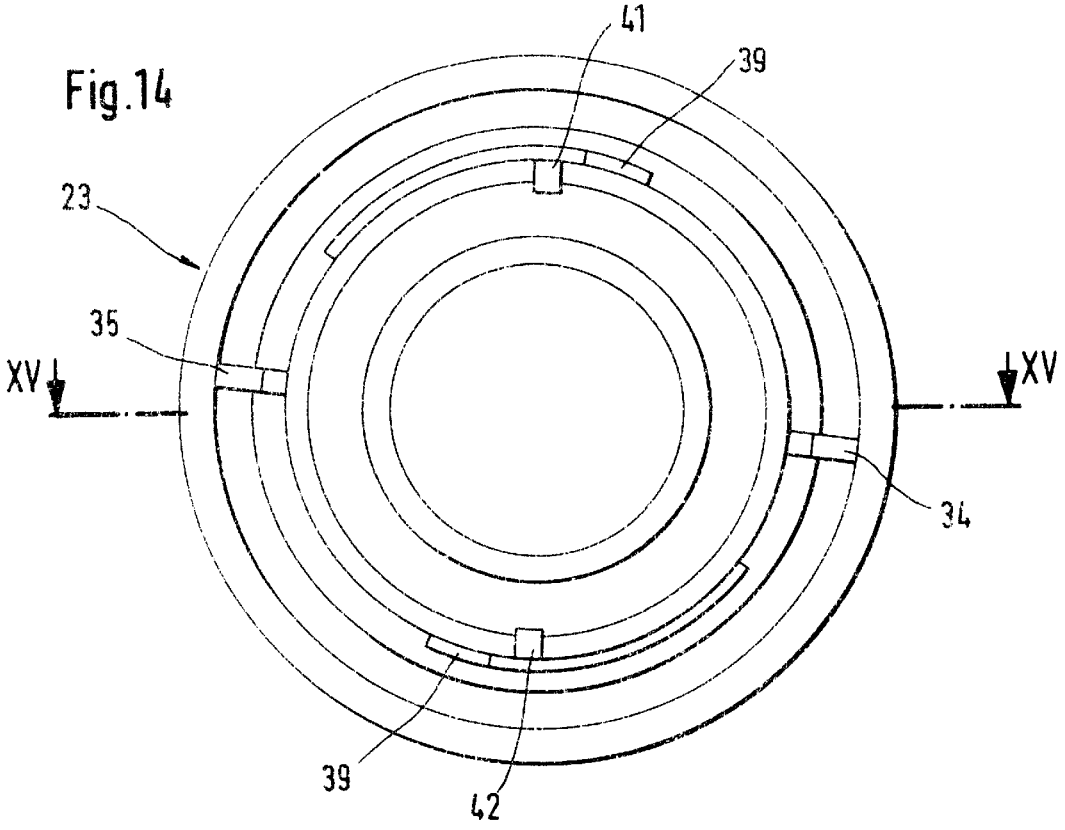
FIG. 14 is a similar section from below, as in FIG. 1, of a closure cap with additional driver cams.
Figure 15:
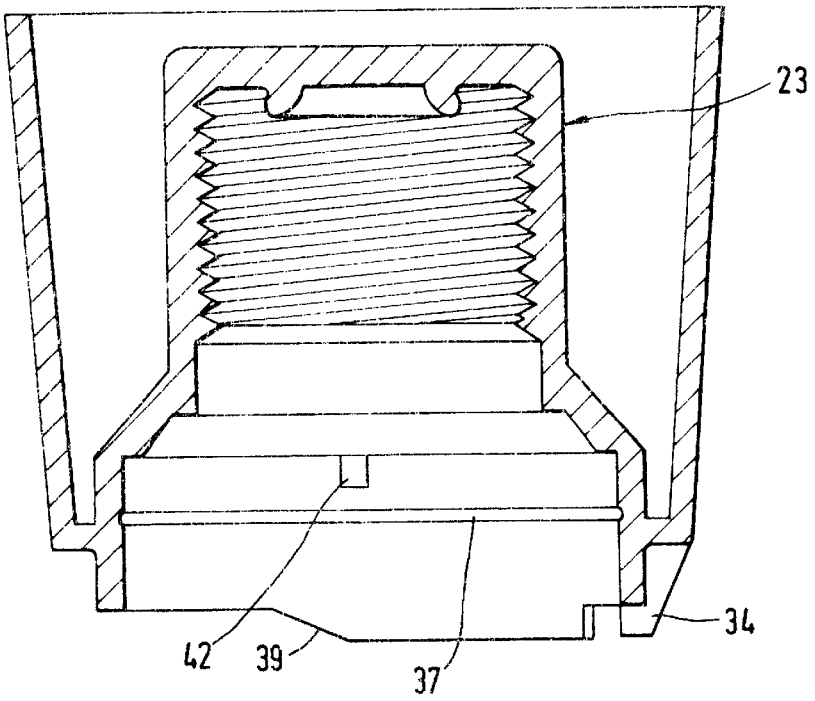
FIG. 15 is a section taken on line 15—15 in FIG. 14.
Figure 16:
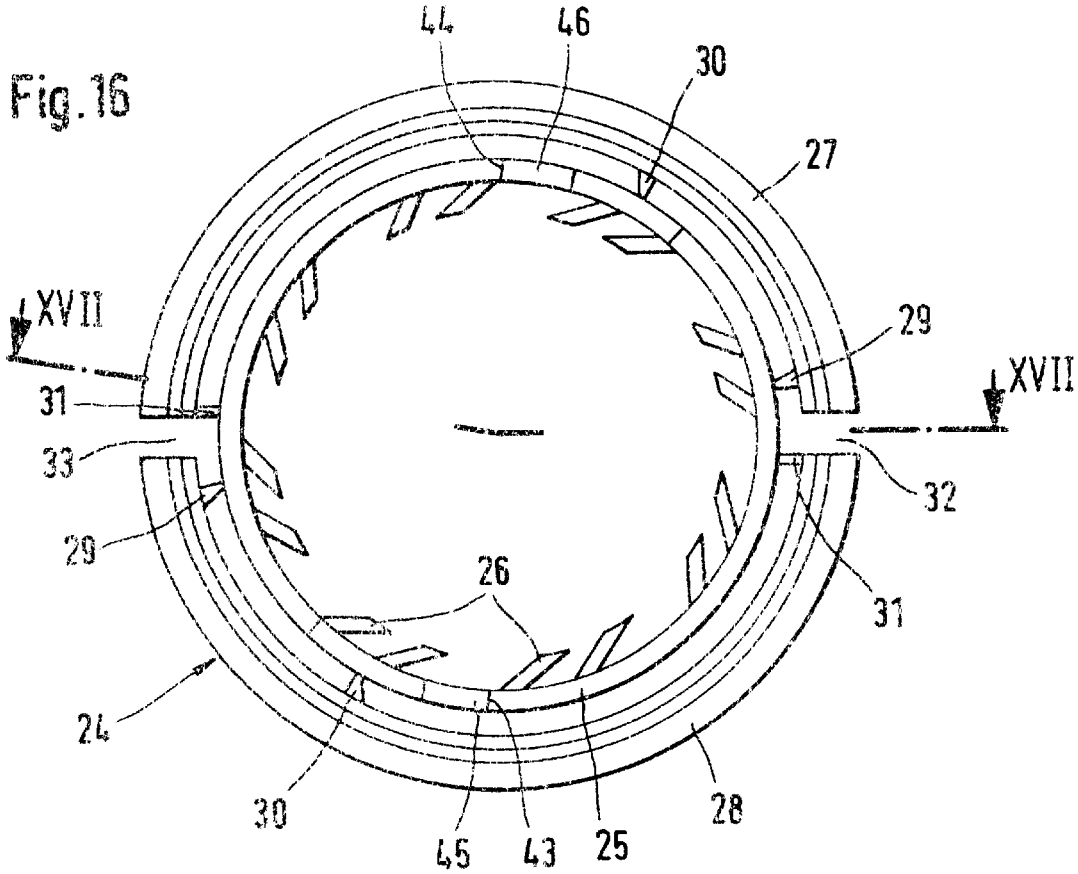
FIG. 16 is a similar plan view as FIG. 3 of a guarantee element with the counter cams corresponding to the engagement cams and FIG. 17 is a section through the guarantee element of FIG. 16 taken on line 17—17 in FIG. 16.
Figure 17:
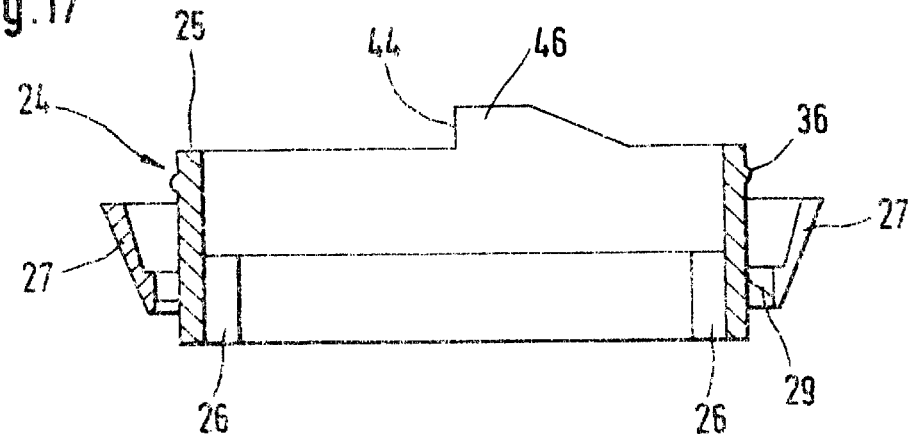

Container closure arrangement embodying the invention includes a container, of which in FIGS. 8 and 9 only one opening region 21 is shown. The opening region 21 comprises a threaded neck 22 onto which the closure cap 23 schematically shown in FIGS. 1 and 2 may be screwed.

Figure 3:
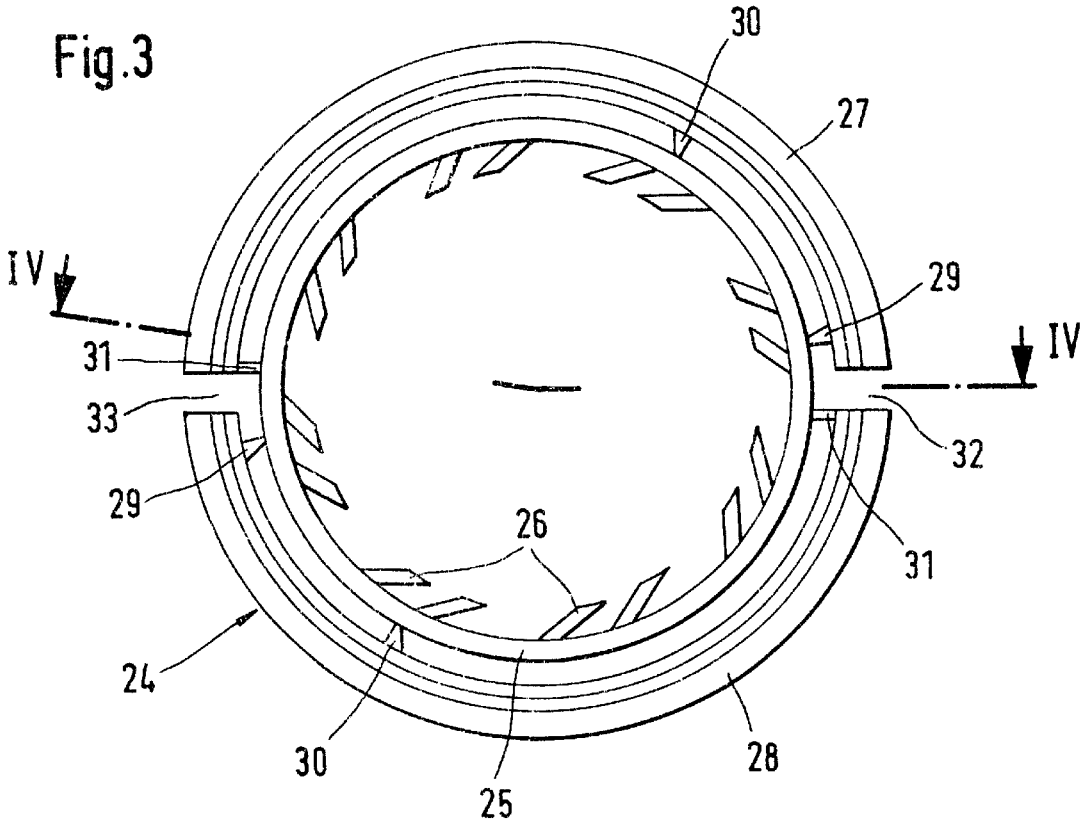
FIG. 3 is a plan view from above of a guarantee element of the container closure arrangement.
Figure 4:
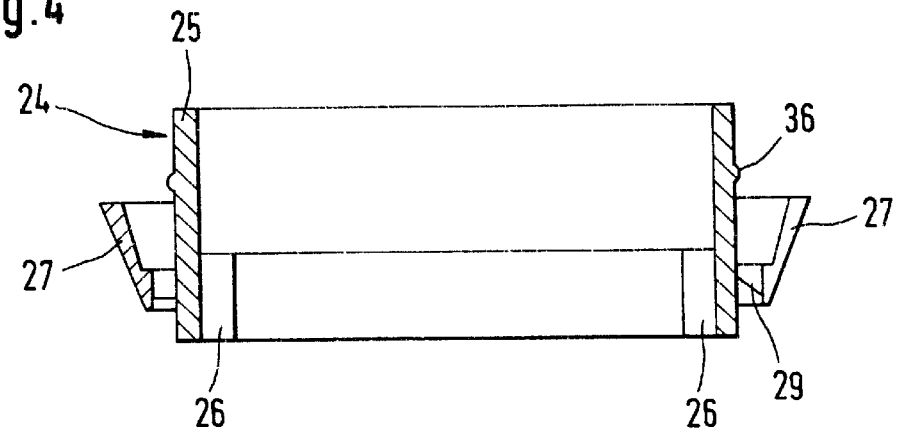
FIG. 4 is a section through the guarantee element taken on line 4—4 in FIG. 3.

Between the opening region 21 of the container and the closure cap 23 there is a guarantee element 24 which is shown in FIGS. 3 and 4. The guarantee element 24 has an annular base body 25 which on its inner side carries roughly saw—tooth shaped latching means 26. Furthermore the guarantee element 24 has two circular—segment—shaped indicator bodies 27 and 28. The indicator bodies 27 and 28 are connected to the base body 25 via break-off webs 29 and further webs 30 and 31. The indicator bodies 27 and 28 are not directly connected to one another but are separated from one another by gaps 32 and 33. The indicator bodies 27 and 28 could also be replaced by only one indicator body which only has one gap and is connected to the base body by a break—off web and further webs.

The base body 25 is initially inserted into the closure cap 23, wherein two axially protruding projections 34 and 35 on the closure cap enter into the gap 32 and 33 between the indicator bodies 27 and 28. The projections 34 and 35 are each accommodated between the ends (seen in the circumferential direction) of the indicator bodies 27 and 28 neighboring one another. By way of the projection 34, 35 the angular position of the guarantee element 24 with respect to the closure cap 23 is unambiguously fixed. With only one indicator body, the closure cap would of course only have one axial protruding projection which would be accommodated between the two ends of the indicator body. The closure cap 23 and the base body 25 comprise cooperating latching means for the non-positive but rotatable axial holding of the base body in the closure cap. These latching means are represented as an annular bulge 36 on the circumference of the base body 25, this annular bulge able to engage into an annular groove 37 in the closure cap 23.

The closure cap 23, together with the guarantee element 24, is screwed onto the threaded neck 22 of the container, where up on the saw-tooth shaped latching means 26 on the base body 25 of the guarantee element snaps over complementary latching means 38 in the form of for example axis-parallel ribs on the opening region 21 of the container. In FIG. 9, the closure cap is shown completely screwed on.

When the closure cap 23 is later screwed off, the threaded neck 22 of the container the base body 25 may not co-rotate since its saw-tooth shaped latching means 26 in the unscrewing direction engage with the ribs 38 on the opening region 21 of the container. The projections 34 and 35 on the closure cap 23, however, engage the indicator bodies 27 and 28. Consequently, the indicator bodies are first torn at the break-off webs 29 from the base body 25.

It has already been mentioned that by way of the projections 34, 35 the angular position of the guarantee element 24 with respect to the closure cap 23 is unambiguously fixed. In the unscrewing direction, the front ends of the projections 34, 35 in relation to the thread beginning on the threaded neck 22 and in relation to the thread beginning in the closure cap 23 are arranged such that when closure cap 23 screwed onto the container, the projections 34, 35 and the guarantee element 24 assume predetermined angular positions with respect to the container. These angular positions may be selected such that one of the locations at which the indicator bodies 27 and 28 on unscrewing the closure cap 23 are initially released from the base body (at one of the break-off webs 29 and at one of the gaps 32, 33) is optimally visible on the container. With unround containers, e.g. oval bottles, oval tubes or bag packagings, the mentioned break-open location may usefully lie in a middle region of one flat side. Some containers receive a print or label and are presented at the places of sales such that the print or label is visible. With such containers a release location of the indicator body 27, 28 may usefully be directed to a middle region of the print or of the label.

It may be desirable after the first opening of the container to distinctly protrude the indicator bodies 27, 28 to the outside. This may be achieved by way of inclined ramps 39 (FIGS. 1, 2) on the closure cap 23 which run in the circumferential direction, protrude axially and on rotating the closure cap in the unscrewing direction press the circular-segment-shaped indicator bodies 27, 28 away from the base body 25.

Figure 5:
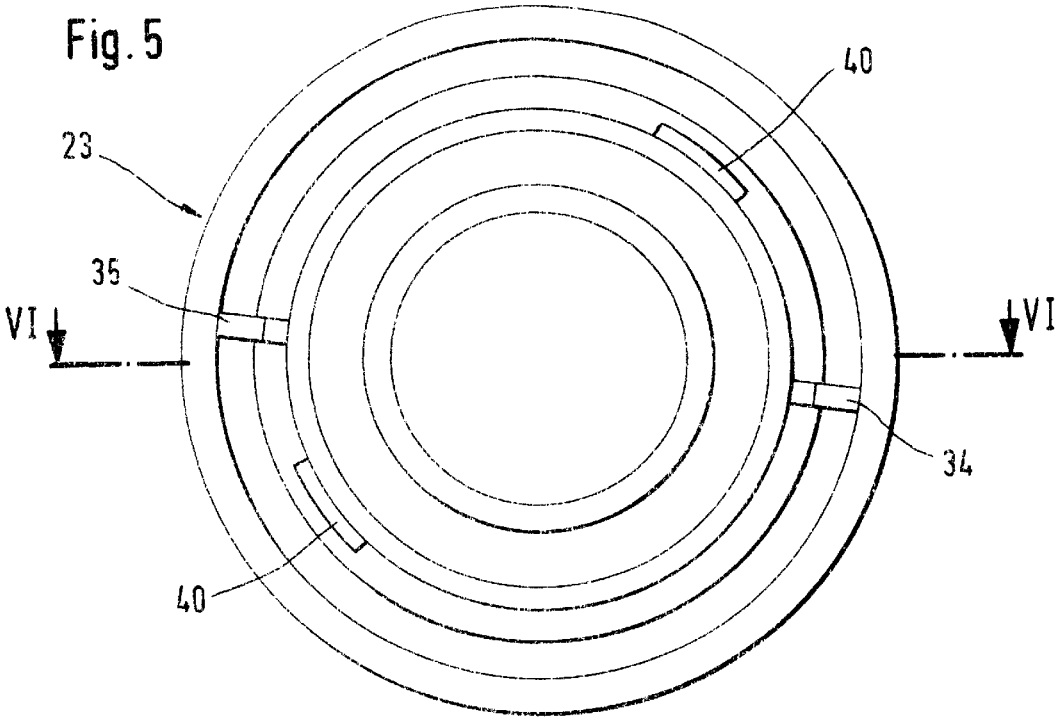
FIG. 5 is a view of a closure cap according to one variant, from below.
Figure 6:
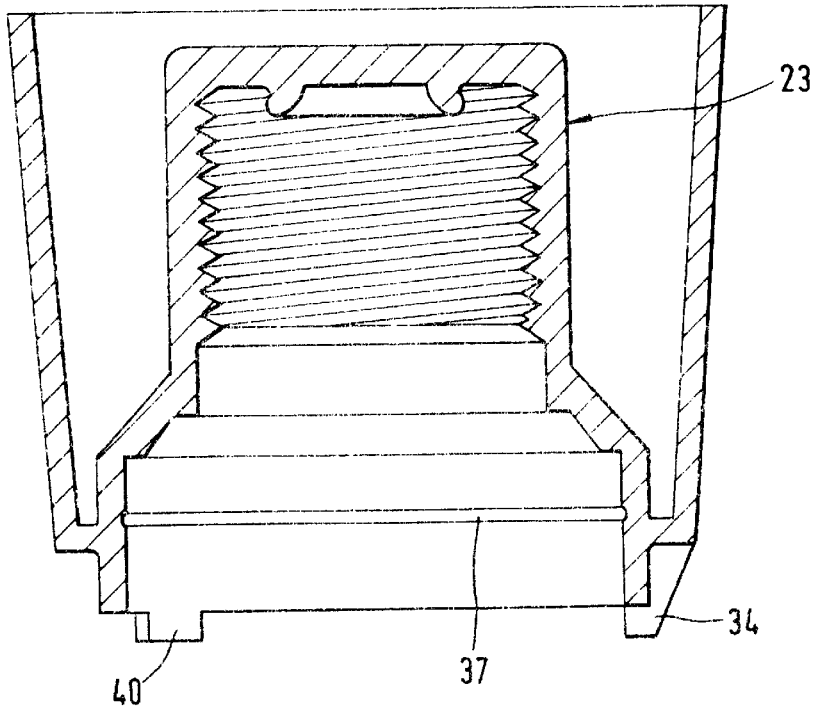
FIG. 6 is a section taken on line 6—6 in FIG. 5.
Figure 7:
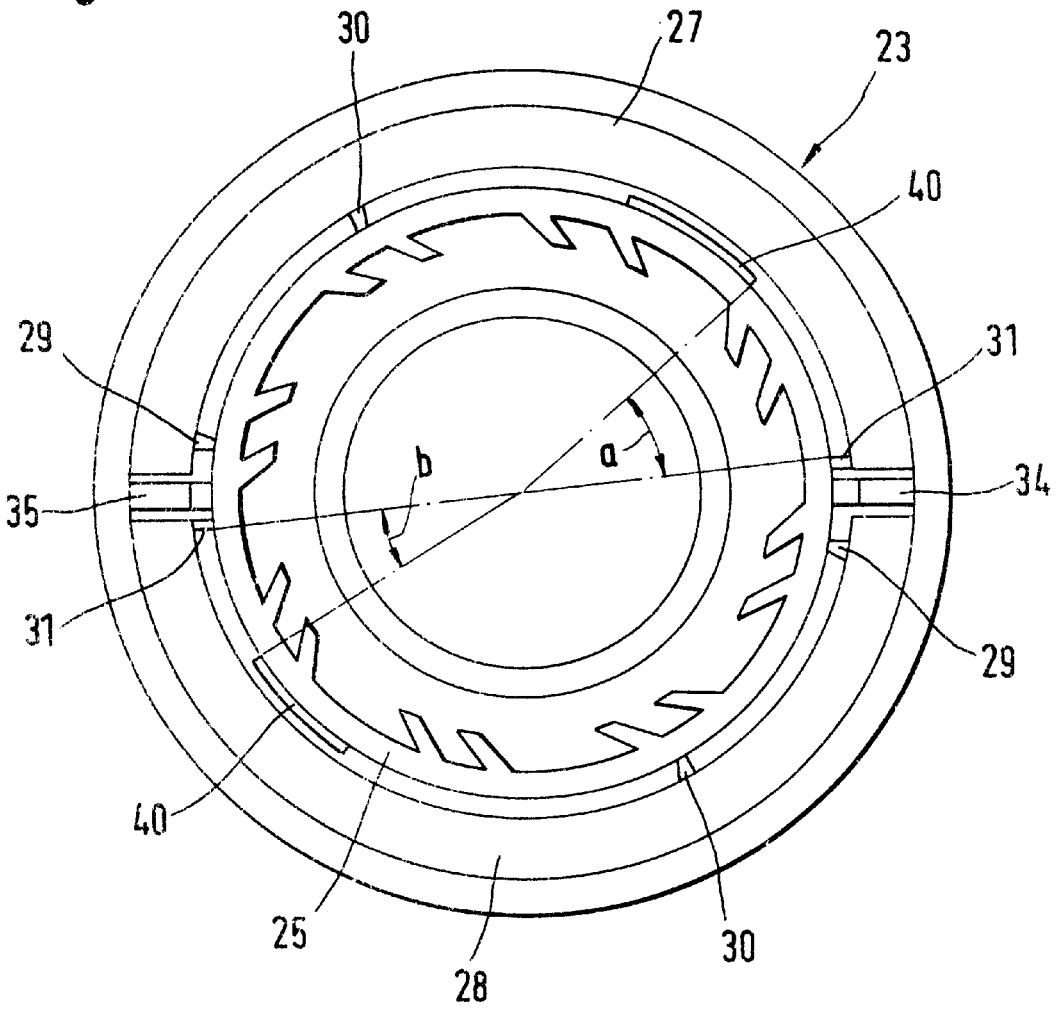
FIG. 7 is a view of the guarantee element of FIG. 3, applied into the closure cap of FIG. 5 and 6, from below.

It may also be desirable with the first opening of the container to completely separate the indicator bodies 27, 28 from the base body 25 so that they do not get in the way in the daily use of the container. For this purpose on the closure cap 23 in place of the inclined ramps there may be arranged axially protruding second projections, as shown in FIG. 5 and 6 which, on rotating in the unscrewing direction the closure cap screwed onto the threaded neck, shear off the indicator bodies 27, 28 from the base body 25. If two (or more) indicator bodies are present, of which each, via the break-off web 29 and at least one second break-off web 31, is connected to the base body 25, it is useful for the closure cap 23 likewise to comprise two (or more) axially protruding second projections 40, and for the guarantee element 24 constructed together with the closure cap, as shown in FIG. 7, for the angular distances a and b between the second projections 40 and the second break-off webs 31 following the second projections 40 in the unscrewing direction to be unequal. This has the advantage that on rotating in the unscrewing direction the closure cap 23 screwed onto the threaded neck, the second projections 40 do not simultaneously meet the second break-off webs 31 so that at some point the torque exerted on the closure cap 23 in each case need only be sufficient for shearing off one of the break-off webs 31. The unequal angular distances a and b may be selected such that the projections 40 on the closure cap 23 are arranged asymmetrically, that is to say non-uniformly distributed on the circumference. It is however also possible for the break-off webs 30 in the guarantee element to be non-uniformly distributed on the circumference.

In FIGS. 10 to 13, a closure cap 123 and a guarantee element 124 of a somewhat different form is represented schematically. The guarantee element 124 has an annular base body 125 which on its inner side carries roughly saw-tooth shaped latching means 126. Furthermore the guarantee element 124 has an indicator body 127 which is connected to the base body 125 via break-off webs 129. Of course, two or more such indicator bodies may be arranged on the base body 125.

The base body 125 is initially inserted into the closure cap 123 wherein an axially protruding projection 134 on the closure cap is accommodated between the two ends (seen in the circumferential direction) of the indicator body. By way of the projection 134, the angular position of the guarantee element 124 with respect to the closure cap 123 is unambiguously fixed. The closure cap 123 and the base body 125 comprise cooperating latching means for the non-positive, but rotatable axial holding of the base body in the closure cap. These latching means are represented as an annular bulge 136 on the circumference of the base body 125, this annular bulge 137 being able to engage into the annular groove 137 in the closure cap 123.

Then the closure cap 123 together with the guarantee element 124 is screwed onto the threaded neck 22 of the container (FIG. 8), whereupon the saw-tooth shaped latching means 126 in the base body 125 of the guarantee element 124 snap over the complementary latching means 38 (ribs) on the opening region 21 of the container.

If the closure cap 123 later is unscrewed from the threaded neck 22 of the container, the base body 125 may not co-rotate, since its saw-tooth shaped latching means 126 in the unscrewing direction engage with the ribs 38 on the opening region 21 of the container. The projection 134 on the closure cap 123 however engages the indicator body 127.

By way of this the indicator body 127 at the break-off webs 129 is torn from the base body 125.

It has already been mentioned that by way of the projection 134, the angular position of the guarantee element 124 with respect to the closure cap 123 is unambiguously fixed. In the unscrewing direction, the front end of the projection 134 is, in relation to the thread beginning, arranged in the closure cap 123 such that when a closure cap 123 screwed on the container, the projection 134 and the guarantee element 124 assume a predetermined angular position with respect to the container. This angular position may be selected such that the location at which the indicator body 127 on unscrewing the closure cap 123 is initially released from the base body 125 (at one of the break-off webs 129) is optimally visible on the container. With unround containers, e.g. oval bottles, oval tubes or bag packages, the mentioned breaking-open location may usefully lie in a middle region of a flat side of the container. Some containers obtain a print or a label and at the place of sales are presented such that the print or label is visible. With such containers the release location of the indicator body 127 may usefully be directed to the middle region of the print or of the label.

With the assembly of the container closure arrangements according to the invention as a rule, as described above, initially the base body 25 and 125 of the guarantee element 24 and 124 respectively are stuck together with the closure cap 23 and 123 respectively and then the closure cap and the guarantee element together are screwed onto the threaded neck 22 of the container. The screwing-on torque at the same time for practical reasons is preferably exerted on the closure cap 23 and 123. The torque required for the co-rotation of the base body 25 and 125 in the previously mentioned embodiment examples is transmitted by the axially protruding projections 34 and 134 onto the indicator bodies 27, 28 and 129 respectively and from these via the break-off webs, such as 29 and 129 onto the base body 25 and 125 respectively. The torque to be transmitted via the break-off webs has a certain value, since the saw-tooth-like latching means 26 and 126 in the base body 25 and 125 respectively as described must snap over complementary latching means 38 on the opening region 22 of the container. Therefore in certain cases there may exist the danger that break-off webs break when screwing onto the threaded neck 22.

This danger may be counteracted by providing at least one driver cam which, on screwing the closure cap with the guarantee element onto the threaded neck of the container, bears on a counter-cam on the base body of the guarantee element and transmits the required torque directly from the closure cap onto the base body. A corresponding embodiment form is represented in FIGS. 14 to 17.

FIGS. 14 to 17, as FIGS. 1 to 4, show a closure cap 23 with axially protruding projections 34, 35 and a guarantee element 24 which comprises the annular base body 25 with the saw-tooth-shaped latching means 26 and the circle-segment-shaped indicator bodies 27, 28. Additionally on the closure cap 23 there are arranged two driver cams 41 and 42. These driver cams 41, 42 on screwing the closure cap 23 with the guarantee element 24 onto the threaded neck of the container bear on (in the unscrewing direction) the rear sides 43 and 44 of counter cams 45 and 46 respectively, these being arranged on the base body 25.

What is claimed is:

1. A container closure arrangement comprising a container having an opening region having a threaded neck and a first latching element and a closure cap which may be screwed onto the threaded neck, said cap having a guarantee element which comprises an annular base body having a second latching element which in an unscrewing direction can engage said first latching element and at least one indicator body which may be brought into rotationally fixed engagement with the closure cap said indicator body having circumferential ends and being connected by at least one break-off web to the base body, wherein the closure cap comprises at least one axially protruding protection accommodated in a space between opposed indicator body ends.

2. A container closure arrangement according to claim 1, wherein the container comprises a front side and a rear side and a first face of the axially protruding projection is arranged with respect to the closure cap in such a manner that on placing the closure cap on the threaded neck a first face of the axially protruding projection is located in the region of the front side of the container whereby the location is optimally visible when the closure cap is unscrewed and the indicator body is released from the base body.

3. A container closure arrangement according to claim 1, wherein the closure cap comprises protruding inclined ramps running in the circumferential direction which, on rotating in the unscrewing direction the closure cap screwed onto the threaded neck, press the base body and the indicator body away from one another.

4. A container closure arrangement according to claim 1, wherein the closure cap comprises axially protruding second projections running in the circumferential direction which, on rotating in the unscrewing direction the closure cap screwed onto the threaded neck, shear the indicator body from the base body.

5. A container closure arrangement according to claim 4, comprising at least two circular-segment-shaped indicator bodies of which each at least via, in the unscrewing direction a one first and one second break-off web is connected to the base body, wherein the closure cap comprises at least two axially protruding second projections and that with the guarantee element constructed together with the closure cap the angular distances between the second projections and the second break-off webs following the second projections in the unscrewing direction are unequal so that on rotating in the unscrewing direction the closure cap screwed onto the threaded neck, the second projection do not simultaneously meet the second break-off webs.

6. A container closure arrangement according to claim 1, wherein the closure cap and the base body comprise cooperating third latching elements for bringing into rotationally fixed engagement the base body with respect to the closure cap.

7. A container closure arrangement according to claim 1, wherein at least one driver is arranged on the closure cap, which cam, on screwing the closure cap with the guarantee element onto the threaded neck to the container, bears on a counter cam on the base body of the guarantee element.

* * * * *